United States Patent [19]

Nozaki et al.

[11] Patent Number: 4,786,781

[45] Date of Patent: Nov. 22, 1988

[54] SILICON NITRIDE GLOW PLUG WITH ALUMINA CORROSION AND EROSION PROTECTIVE COATING

[75] Inventors: Shunkichi Nozaki; Yukihiro Kimura, both of Aichi, Japan

[73] Assignee: NGK Spark Plug Co., Ltd., Aichi, Japan

[21] Appl. No.: 144,725

[22] Filed: Jan. 14, 1988

Related U.S. Application Data

[63] Continuation of Ser. No. 792,846, Oct. 30, 1985, abandoned.

[30] Foreign Application Priority Data

Oct. 31, 1984 [JP] Japan ..... 59-227999

[51] Int. Cl.[4] ..... H05B 3/28; F23Q 7/00; F02P 19/02

[52] U.S. Cl. ..... 219/270; 123/145 A; 219/552; 219/553; 361/264

[58] Field of Search ..... 219/270, 552, 553, 523, 219/544; 123/145 R, 145 A; 361/264–266; 423/324

[56] References Cited

U.S. PATENT DOCUMENTS 4,336,304 6/1982 Landingham et al. ..... 219/553 X
4,336,305 6/1982 Tanaka ..... 423/324 X
4,418,661 12/1983 Esper et al. ..... 123/145 A
4,502,430 3/1985 Yokoi et al. ..... 219/270
4,556,780 12/1985 Atsumi et al. ..... 219/270

FOREIGN PATENT DOCUMENTS 90595 7/1979 Japan ..... 219/270
113663 9/1980 Japan ..... 219/270
146929 11/1981 Japan ..... 219/270

*Primary Examiner*—Anthony Bartis
*Attorney, Agent, or Firm*—Finnegan, Henderson, Farabow, Garrett & Dunner

[57] ABSTRACT

A ceramic glow plug comprises a ceramic heater formed by embedding a metal wire in a sintered $Si_3N_4$-based ceramic. The ceramic heater is brazed to the inner surface of an axial bore of a metal tube and the metal tube is brazed to the inner surface of an axial bore of a metal holder. The tip of the ceramic heater extends from the metal tube and metal holder and is coated with highly heat and corrosion resistant material to minimize erosion and corrosion due to combustion gases. The coating consists essentially of a thin CVD film of alumina ($Al_2O_3$) having a thickness of 2 μm deposited on a precoating AlON layer having a thickness of 0.5 μm formed on the exposed surface of the tip. Alternatively, the protective coating may consist of thin CVD film of silicon carbide (SiC) or silicon nitride ($Si_3N_4$) formed directly on the exposed surface of the tip.

4 Claims, 1 Drawing Sheet

SILICON NITRIDE GLOW PLUG WITH ALUMINA CORROSION AND EROSION PROTECTIVE COATING

This application is a continuation of application Ser. No. 792,846 filed Oct. 30, 1985 now abandoned.

FIELD OF THE INVENTION

The present invention relates to a ceramic glow plug for use in a diesel engine, and more specifically to a glow plug for ensuring rapid starting.

BACKGROUND OF THE INVENTION

Diesel engines are generally slow and difficult to start at low temperatures. To overcome this they are equipped with a glow plug in an auxiliary combustion chamber. The glow plug is heated by an electic current until it is red-hot at which time an air-fuel mixture is introduced into the combustion chamber. The glow plug raises the temperature of the air-fuel mixture sufficiently to permit ignition and engine staring.

The glow plug must withstand the high temperatures of ignition. Also, it must be durable because of the common use of a glow plug as an after-glow plug that stabilizes combustion after the engine has been started.

In order to endure frequent rapid heating and use as an after-glow plug, conventional glow plugs have used a ceramic heater as a heating element. The ceramic heater is prepared by shaping and sintering a silicon nitride ($Si_3N_4$) based ceramic powder having a wire heater embedded therein. The wire is made from a metal with a high melting point such as tungsten.

The essential parts of a conventional ceramic glow plug are shown in partial cross section in FIG. 2. A ceramic heater 2 (hereinafter referred to simply as "heater") having a coil of heating wire 1 embedded therein is brazed to the inner surface of a bore in a metal tube 3. A heating tip 2—1 is left exposed. A lead wire 1—1 is connected to one end of the coil 1 and at its other end is electrically connected to the metal tube 3. The metal tube 3 is brazed to the lower end of an axial bore of a metal holder 4. The metal holder 4 is connected to a negative electrode. A lead wire 1—2 is connected to the other end of the coil 1, extends from the rear of the heater 2, and is connected to a positive electrode terminal (not shown). The lead wire 1—2 is insulated from the metal holder 4 at the rear end of the glow plug.

In the heater 2 of the conventional ceramic glow plug shown in FIG. 2, sintering aids, e.g. $Al_2O_3$, $Y_2O_3$ and $M_gO$, incorporated in the silicon nitride sinter react with the latter to form glassy material between $Si_3N_4$ particles. In the prior art, the sintered surface of the heater is not given any finishing treatment or is sometimes polished. The tip of the heater is inserted into the combustion chamber of the engine and is exposed directly to a high-pressure and high-speed gas stream in a transient atmosphere where a temperature of 1,000° C. or higher is prevalent. Simultaneous oxidation and reduction occur under these conditions.

The glassy material between silicon nitride particles is eroded, corroded, or otherwise broken down to cause gradual thinning of the heater. As a result, heat condition from the wire heater 1 buried in the ceramic matrix varies greatly and not only does it become impossible to attain the desired high temperature but cracks may develop in the ceramic matrix. Thus, until now glow plugs have not performed in a completely satisfactory manner.

OBJECTS AND SUMMARY OF THE INVENTION

An object of the present invention is a ceramic glow plug capable of withstanding very high temperatures.

Another object of the present invention is a ceramic glow plug capable of acceptable operation over a long period of time under severe conditions.

A further object of the present invention is a ceramic glow plug that is crack resistant.

Still a further object of the present invention is a ceramic glow plug that will not erode, corrode, or be broken down under prolonged operation.

These and other objects are attained by a ceramic glow plug comprising a ceramic heater including a wire heater embedded in a sintered $Si_3N_4$-based ceramic, a metal tube having a bore for receiving a portion of the ceramic heater not including the tip thereof, a metal holder having an axial bore for receiving a portion of the metal tube, and a heat resistant coating selected from the group consisting of SiC, $Al_2O_3$, and $Si_3N_4$, the coating being formed by CVD for covering the portion of the ceramic heater not received in the bore of the metal tube.

BRIEF DESCRIPTION OF THE DRAWINGS

The manner in which the above objects and other objects, features, and advantages of the present are attained will be better understood from the following detailed description when considered in view of drawings, wherein:

FIG. 1(*b*) shows the glow plug of FIG. 1(*a*) undergoing a process for coating heat-resistant material on a portion of the glow plug.

DETAILED DESCRIPTION

With a view to solving the above described problems associated with the conventional ceramic glow plugs, the present invention contemplates protecting the portion of the heater which is exposed in the combustion chamber of the engine by providing on the surface of that portion a coating of heat-resistant material. As a result of numerous experiments conducted on the basis of this approach, the inventors found that good results can be obtained by providing a coating of SiC, $Al_2O_3$, or $Si_3N_4$ on the exposed surface of the heater by chemical vapor deposition (CVD). The observations obtained were as follows: (1) a heater with a SiC coat of a thickness of 5 $\mu$m peformed satisfactorily by withstanding a high temperature of 1,300° C. throughout the test period; (2) an $Al_2O_3$ coating had a high thermal expansion but good results were obtained by depositing an $Al_2O_3$ coating with a thickness of 2 $\mu$m on a 0.5 $\mu$m thick AlON layer formed on a preliminarily treated surface; and (3) a heater with a $Si_3N_4$ coat was unable to withstand prolonged service at temperatures of 1,250° C. or higher since $Si_3N_4$ reacted with the glassy material in the ceramic matrix to form $SiO_2$. Even this heater, however, is satisfactory for practical purposes since the temperature in the combustion chamber does not exceed 1,250° C. Whichever material is used, the surface of the heater tip exposed in the combustion chamber was protected from the corrosive or erosive attacks of hot combustion gases flowing at high pressures and high velocities.

Figure 1A:
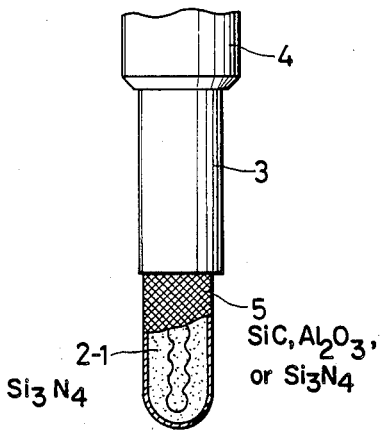
FIG. 1(*a*) is a partial, longitudinal cross section of an embodiment of the ceramic glow plug of the present invention.
Figure 1B:
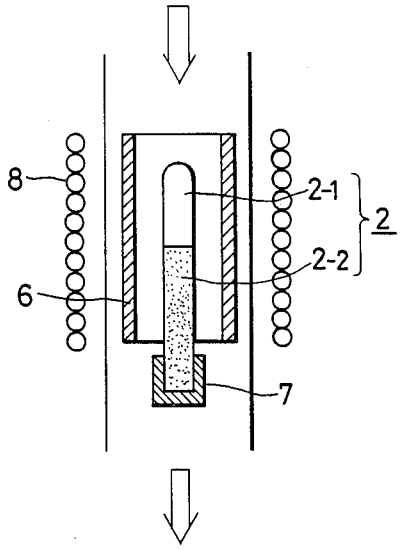
Figure 2:
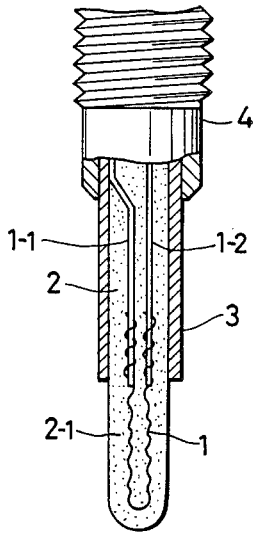
FIG. 2 PRIOR ART
FIG. 2 is longitudinal cross section of a conventional glow plug.

An embodiment of the ceramic glow plug of the present invention will be described with reference to FIGS. 1(*a*) and 1(*b*) wherein the components which are the same as those shown in FIG. 2 are identified by like reference numerals.

As shown in FIG. 1(*a*), the heating tip 2—1 of the heater that is brazed to the inner surface of the bore in the metal tube 3 has a portion that projects from the tube. That portion is provided with a heat-resistant coating 5 formed of SiC, $Al_2O_3$ or $Si_3N_4$ by CVD. A specific mode of forming the coating 5 is hereunder described with particular reference to FIG. 1(*b*).

The heater element 2 is coated with a paste in all areas 2—2 except for the heating tip 2—1 that is to be provided with the heat-resistant coating. The paste is a blend of a graphite powder (#120) and a binder (e.g. phenolic resin). The heater element with the paste layer is inserted into a reactor tube 6 and fixed at one end with a graphite holder 7.

If the heat-resistant coating to be formed is SiC, trichloromethyl silane carried in $H_2$ gas is introduced into the reactor tube 6 in the direction indicated by the arrows, and the heater element 2 is heated to 1,200°-1,250° C. for 5 minutes by an RF induction heater 8 until a SiC coating with a thickness of about 10 μm is formed on the surface of the element 2. Thereafter, the element is taken out of the reactor tube and the graphite layer is removed to provide a heater having a SiC coating 5 on the surface of the heating tip 2—1.

Throughout the treatment for the formation of the heat resistant coating, the heater element should be held at a temperature between 1,200° and 1,250° C. because at temperatures below 1,200° C., the reaction rate drops to an extremely low level and at temperatures above 1,250° C. excessively fast crystal growth occurs to produce a coarse film of heat-resistant material.

When CVD treatment was conducted at a reduced pressure of 100 Torr, 20 minutes were required to form a coating with a thickness of 10 μm. The thickness of the coating was uniform, however, and several tens of heater elements could be treated by this method.

The coating of an $Al_2O_3$ film was produced as follows. As in the case of the formation of a SiC coating, the heater element 2 was fixed in the reactor tube 6 and a mixture of $A1C1_3$ and $CO_2$carried by a gaseous mixture of $H_2$ and $N_2$ was introduced through the reactor while it was held at 10 Torr and 1,000° C. for a period of 1 hour to form an A1ON coating with a thickness of 0.5 μm on the surface of the heating tip 2—1. Subsequently, a mixture of $AlCl_3$ and $CO_2$ was passed through the reactor using $H_2$ as a single carrier gas, and the heater element was held at 10 Torr and 1,000° C. for 2 hours to form a $Al_2O_3$ coating with a thickness of 2 μm on the A1ON film on the surface of the heating tip 2—1.

The coating of a $Si_3N_4$ film was made by the following procedure. As in the case of the formation of a SiC coat, the heater element 2 was fixed in the reactor tube 6 and a mixture of $SiCl_4$ and $N_2$ carried by $H_2$ gas was caused to flow through the reactor. In this way, thermal CVD treatment was conducted to form a $Si_3N_4$ coating on the surface of the heating tip 2—1.

In the embodiments shown, a small CVD apparatus equipped with a RF inductive heater was used, but it should be understood that heating may be performed by other principles such as resistance heating and infrared radiation heating.

In accordance with the above described processes, ceramic heaters were prepared with the three different coatings 5 formed individually on the surfaces of the heating tips 2—1 as shown in FIG. 1(*a*). The coatings were of the same compositions as used in the above embodiments. These samples were subjected to a laboratory-scale test, wherein an electric current was applied to each heating tip 2—1 to elevate its temperature to 1,200° C. 1,250° C., 1,300° C., and 1,350° C. in water vapor at one atmosphere. A control sample having no heat-resistant coating was prepared and subjected to the same test. The diameter of the control sample, which was initially 3.0 mm, but decreased to 2.95 mm when it was held at 1,200° C. for 50 hours. On the other hand, the heating tips 2—1 prepared in accordance with the present invention performed without any trouble throughout the test period at the temperatures selected.

Glow plugs including ceramic heaters according to the present invention, which were prepared as above, were fitted in an automobile diesel engine which was run under high load for 200 consecutive hours while the surface temperature of the heating tip of each heater was held at 1,050° C. The heater samples were checked for thinning at intervals of 50 hours. At 200 hours, the diameter of the control sample heater tip decreased from 3.0 mm to 2.9 mm, but the heater tips prepared in accordance with the present invention performed quite satisfactory, each of the respective diameters having decreased less than about 0.05 mm. indicating the effectiveness of the heat-resistant coatings.

The basis on which the glow plugs of the present invention were found to be superior to the above-described control sample plugs was that in each case the glow plugs of the present invention experienced less erosion or corrosion, in terms of reduction in heater tip diameter.

As will be understood from the foregoing description, the protective coating of a heat and corrosion resistant material formed on the surface of the heater tip that is exposed from the metal tube of the ceramic glow plug of the present invention minimizes the occurrence of erosion and corrosion due to combustion gases and prevents the heater from troublesome wearing during use. Therefore, the present invention is capable of providing a ceramic glow plug that has solved the problem of low durability associated with the conventional $Si_3N_4$-based ceramic heater by providing alternative CVD-formed heat-resistant coatings having the following constituents: a SiC layer of about 5 μm to 10 μm; an $Al_2O_3$ layer of about 2 μm on an underlayer of AlON of about 0.5 μm; or a $Si_3N_4$ layer.

What is claimed is:

1. A ceramic glow plug comprising:

a metal tube having an axial bore;

a sintered ceramic heater including a wire embedded in sintered $Si_3N_4$-based ceramic, said ceramic heater having a tip portion and being attached to the inner surface of said axial bore of said metal tube such that said tip of said ceramic heater extends from an end of said bore of said metal tube and is exposed;

a metal holder having an axial bore, said metal tube being attached at its other end to the inner surface of said axial bore of said metal holder; and a heat-resistant coating covering the exposed surface of said tip of said ceramic heater, wherein said heat-resistant coating consists essentially of a thin CVD film of alumina having a thickness of about 2 μm and wherein an AlON pre-coating layer is first formed on the exposed surface of said ceramic heater tip, and said alumina coating is formed on the AlON layer.

2. The ceramic glow plug according to claim 1, wherein said ceramic heater is brazed to said axial bore of said metal tube and said metal tube is brazed to said axial bore of said metal holder.

3. The ceramic glow plug according to claim 1 wherein the thickness of said AlON layer is about 0.5 μm.

4. A method for forming a heat-resistant alumina coating over an AlON pre-coating layer on a sintered silicon nitride glow plug heater tip comprising the steps of:

heating the heater tip to about 1,000° C.;

exposing the heated heater tip to a streaming gaseous mixture including $AlCl_3$, carbon dioxide, hydrogen, and nitrogen at a reduced pressure of about 10 Torr for a time sufficient to form an A1ON pre-coating layer of about 0.5 μm thickness;

exposing the heated heater tip having the AlON coating to a second, nitrogen-free, streaming gaseous mixture including $AlCl_3$, carbon dioxide and hydrogen at a pressure of about 10 Torr for a time sufficient to form an alumina coating layer thickness of about 2 μm.

* * * * *